United States Patent [19]

Saeki et al.

[11] Patent Number: 4,861,748

[45] **Date of Patent: * Aug. 29, 1989**

[54] RECORDING MATERIAL

[75] Inventors: Keiso Saeki; Masanobu Takashima; Ken Iwakura, all of Shizuoka, Japan

[73] Assignee: Fuji Photo Film Co., Ltd., Kanagawa, Japan

[ * ] Notice: The portion of the term of this patent subsequent to Dec. 21, 2088 has been disclaimed.

[21] Appl. No.: 71,683

[22] Filed: Jul. 9, 1987

[30] Foreign Application Priority Data

Jul. 9, 1986 [JP] Japan ..... 61-161495
Jul. 28, 1986 [JP] Japan ..... 61-177381

[51] Int. Cl.[4] ..... B41M 5/16; B41M 5/18; B41M 5/22

[52] U.S. Cl. ..... 503/208; 427/151; 428/913; 428/914; 503/212; 503/216; 503/217; 503/220; 503/223

[58] Field of Search ..... 427/151; 503/216, 217, 503/220, 223, 225, 208, 212, 215; 428/913, 914

[56] References Cited

U.S. PATENT DOCUMENTS 4,295,663 10/1981 Petitpiere .
4,508,897 4/1985 Bedekovic et al. ..... 503/220
4,688,060 8/1987 Tanaka et al. ..... 503/214

FOREIGN PATENT DOCUMENTS 2040303 8/1980 United Kingdom .
2141729 1/1985 United Kingdom .
2148923 6/1985 United Kingdom ..... 503/220

*Primary Examiner*—Bruce H. Hess
*Attorney, Agent, or Firm*—Sughrue, Mion, Zinn, Macpeak & Seas

[57] ABSTRACT

A recording material containing the combination of at least one electron-donating colorless dye containing a p-substituted aminophenylindolyl azaphthalide and at least one electron-accepting compound containing an organic acid having at least one phenolic hydroxyl group. The material provides colored images having improved stability.

18 Claims, No Drawings

RECORDING MATERIAL

FIELD OF THE INVENTION

The present invention relates to a recording material and more particularly to a recording material having improved stability of color images.

BACKGROUND OF THE INVENTION

Recording materials using an electron-donating colorless dye (hereinafter referred to as a "color former") and an electron-accepting compound (hereinafter referred to as a "developer") are already well known as a pressure-sensitive paper, a heat-sensitive paper, a light-sensitive and pressure-sensitive paper, an electric heat-sensitive paper and the like. Such papers are disclosed in detail, for example, in British Pat. No. 2,140,449, U.S. Pat. Nos. 4,480,052, 4,436,920, 3,775,424, 4,181,328 (British Pat. No. 1,552,517), European Pat. No. 82822, Japanese Patent Application (OPI) Nos. 179836/82, 123556/85 and 123557/85 (the term "OPI" as used herein means an "unexamined published Japanese patent application").

In a good recording material, (1) both color density and color sensitivity should be sufficient, (2) fog should not occur, (3) color images should have sufficient color fastness, (4) the hue of color images should be appropriate and suitable for duplicating, (5) the S/N ratio should be high, (6) the chemical resistance of color images should be sufficient, and (7) the recording material should easily be dissolved by an organic solvent. So far, satisfactory recording materials meeting all of the above requirements completely have not been realized.

Recently, with the varied demands for recording systems, extensive research to improve these characteristics has ben conducted. Particularly, sufficient color fastness is in great demand for blue color recording materials.

Diphenylmethane type compounds, triphenylmethane type compounds, phthalide type compounds, leucomethylene blue type compounds and the like are conventionally known as compounds which form a color from blue to bluish-purple. However, each of these compounds has disadvantages. For example, 3,3-bis(p-dimethylaminophenyl)-6-dimethylaminophthalide (i.e., crystal violet lactone) quickly forms a dark blue color, but the light fastness of color images is extremely poor. 3,7-bis(dimethylamino)-10-benzoylphenothiazine (i.e., benzoylleucomethylene blue) as a leucomethylene blue type compound provides excellent light fastness in color images, but color formation is very slow, and in combination with an organic developer color formation is extremely inferior. Furthermore, 3-(4-diethylamino-2-ethoxyphenyl)-3-(1-ethyl-2-methylindol-3-yl)-4- or 7-azaphthalide which is known as a phenylindolylazaphthalide type compound has poor solubility in a solvent used for encapsulation, and self-color-developing properties are very strong.

SUMMARY OF THE INVENTION

An object of the present invention is to provide a recording material having excellent stability of color images and meeting all requirements as described above.

By considering both the coupler and the developer, paying attention to characteristics such as oil solubility, water solubility, distribution coefficient, pKa, polarity of substituents, positions of substitution and the change of crystalline properties and solubility in combination use, the present inventors have investigated and developed excellent recording materials.

As a result of these investigations, it has now been discovered that these and other objects of the present invention are attained by a recording material containing the combination of at least one electron-donating colorless dye containing a p-substituted aminophenylindolylazaphthalide and at least one electron-accepting compound containing an organic acid having at least one phenolic hydroxyl group.

DETAILED DESCRIPTION OF THE INVENTION

Among p-substituted aminophenylindolylazaphthalide derivatives of the present invention, compounds represented by the following formula (I) are preferred.

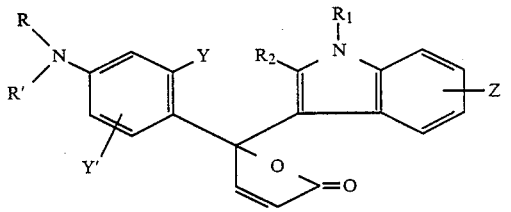

(I)

A

In the above formula, R and R', which may be the same or different, each represents a substituted or unsubstituted alkyl group; $R_1$ and $R_2$, which may be the same or different, each represents a hydrogen atom, a substituted or unsubstituted alkyl group or a substituted or unsubstituted aryl group; Y, Y' and Z, which may be the same or different, each represents a hydrogen atom, a substituted or unsubstituted alkyl group, a halogen atom, a substituted amino group or a substituted or unsubstituted alkoxy group; and A represents an atomic group necessary for completing a pyridine ring or pyrazine ring.

The aryl group represented by $R_1$ and $R_2$ includes a phenyl group, a naphthyl group or a heterocyclic group, and the substituents for the substituted aryl group include an alkyl group, an alkoxy group, an aryloxy group, a halogen atom, a nitro group, a cyano group, a substituted carbamoyl group, a substituted sulfamoyl group, a substituted amino group, a substituted oxycarbonyl group or a substituted oxysulphonyl group. The alkyl group represented by R, R', $R_1$, $R_2$, Y, Y' and Z includes a saturated or unsaturated, straight- or branched chain alkyl group or cycloalkyl group, and the substituents for the substituted alkyl group include an aryl group, an alkoxy group, an aryloxy group, a halogen atom and a cyano group.

In the above formula, preferred groups represented by R or R' include an alkyl group having from 1 to 10 carbon atoms, an alkoxyalkyl group having from 1 to 10 carbon atoms, a halogen atom-substituted alkyl group having from 1 to 10 carbon atoms and an aryloxyalkyl group having from 7 to 12 carbon atoms. Particularly preferred groups represented by R or R' are an ethyl group, an n-butyl group or a benzyl group. Preferred groups represented by $R_1$ include a hydrogen atom, an alkyl group having from 1 to 18 carbon atoms, an alkyl group having from 1 to 18 carbon atoms which is substituted with an aryl group, an alkoxy group, an aryloxy group or a halogen atom; a phenyl group having from 6 to 10 carbon atoms, and a phenyl group having from 6 to 10 carbon atoms which is substituted with an alkyl group, an alkoxy group or a halogen atom. Particularly preferred groups represented by $R_1$ are an ethyl group, an n-butyl group, an n-octyl group, a 2-ethylhexyl group, an n-dodecyl group, an n-octadecyl group, a benzyl group, and a phenoxyethyl group. Preferred groups represented by $R_2$ include a hydrogen atom, an alkyl group having from 1 to 8 carbon atoms and a phenyl group having from 6 to 10 carbon atoms. Particularly preferred groups represented by $R_2$ are a hydrogen atom, a methyl group and a phenyl group. Among the groups represented by Y and Y', a hydrogen atom, an alkyl group having from 1 to 18 carbon atoms, a substituted amino group having from 1 to 18 carbon atoms, and an alkoxy group having from 1 to 18 carbon atoms are preferred. Particularly preferred groups represented by Y or Y' are an ethoxy group, a methoxy group, an n-butoxy group, a benzyloxy group, a methyl group and a hydrogen atom. Among the groups represented by Z, a hydrogen atom, an alkyl group having from 1 to 6 carbon atoms and an alkoxy group having from 1 to 6 carbon atoms are preferred. Particularly preferred groups represented by Z are a hydrogen atom, a chlorine atom, a methyl group and a methoxy group. The ring formed by A is preferably a pyridine ring having a nitrogen atom at the 4-position or the 7-position of the azaphthalide ring formed or a pyrazine ring, and a pyridine ring having a nitrogen atom at the 4-position of the azaphthalide ring is particularly preferred because of reduced fog. In the compound represented by formula (I), particularly preferred is thoes where $R_2$ represents an alkyl group or Y represents an alkoxy group, and the group represented by $R_1$ or Y has 4 or more carton atoms, preferably from 6 to 18 carbon atoms.

It is preferred that the groups represented by R, R', Y, $R_1$ and $R_2$ have a total of at least 8 carbon atoms, because the solubility of the color former in an organic solvent is increased. Specific examples of p-substituted aminophenylindolylazaphthalide derivatives according to the invention include 3-(4-diethylamino-2-ethoxyphenyl)-3-(1-ethyl-2-methylindol-3-yl)-4- or -7-azaphthalide, 3-(4-diethylamino-2-ethoxyphenyl)-3-(1-n-butyl-2-methylindol-3-yl)-4- or -7-azaphthalide, 3-(4-diethylamino-2-ethoxyphenyl)-3-(1-n-octyl-2-methylindol-3-yl)-4-or -7-azaphthalide, 3-(4-diethylamino-2-ethoxyphenyl)-3-[1-(2-ethylhexyl)-2-methylindol-3-yl]-4- or -7-azaphthalide, 3-(4-diethylamino-2-ethoxyphenyl)-3-(1-n-decyl-2-methylindol-3-yl)-4-or -7-azaphthalide, 3-(4-diethylamino-2-ethoxyphenyl)-3-(1-n-dodecyl-2-methylindol-3-yl)-4-or -7-azaphthalide, 3-(4-diethylamino-2-ethoxyphenyl)-3-(1-n-octadecyl-2-methylindol-3-yl)4- or -7-azaphthalide, 3-(4-dibutylamino-2-ethoxyphenyl)-3-(1-n-octyl-2-methylindol-3-yl)-4-or -7-azaphthalide, 3-(4-dibutylamino-2-butoxyphenyl)-3-(1-n-octyl-2-methylindol-3-yl)-4- or -7-azaphthalide, 3-(4-diethylamino-2-ethoxyphenyl)-3-(1-n-octyl-2-phenylindol-3-yl)-4- or -7-azaphthalide, 3-(4-diethylamino-2-ethoxyphenyl)-3-(1-β-phenoxyethyl-2-methylindol-3-yl)-4- or -7-azaphthalide, 3-(4-diethylamino-2-β-phenoxyethoxyphenyl)-3-(1-n-octyl-2-methylindol-3-yl)-4-or -7-azaphthalide, 3-(4-diethylamino-2-ethoxyphenyl)-3-(1-benzyl-2-methylindol-3-yl)-4-or -7-azaphthalide, 3-(4-N-ethyl-N-isoamylamino-2-ethoxyphenyl)-3-(1-n-octyl-2-methylindol-3-yl)-4- or -7-azaphthalide, 3-(4 diethylamino-2-ethoxyphenyl)-3-(1-n-octyl-2-methylindol-3-yl)-4,7-diazaphthalide, 3-(4-diethylamino-2-ethoxyphenyl)-3-(1-n-octa-decyl-2-methylindol-3-yl)-4,7-diazaphthalide, 3-(4-diethylamino-2-ethoxyphenyl)-3-(1-n-dodecyl-2-methylindol-3-yl)-4,7-diazaphthalide, 3-(4-diethylamino-2-n-octyloxyphenyl)-3-(1-ethyl-2-methylindol-3-yl)-4-or -7-azaphthalide, 3-(4-diethylamino-2-n-octadecyloxyphenyl)-3-(1-ethyl-2-methylindol-3-yl)-4-or 7-azaphthalide, and the like. They can be used alone or in combinations two or more.

Among p-substituted aminophenylindolyl phthalide derivatives of the present invention, p-substituted amino-2-alkoxyphenylindolyl-4- or -7-azaphthalides or p-substituted amino-2-alkoxyphenylindolyl-4,7-diazaphthalides are preferred in view of the color hue obtained.

The developer used in the recording material of the present invention is preferably a developer having one or more phenolic hydroxyl groups, such as a salicylic acid derivative, a phenol derivative or a phenolic resin. Among the above derivatives, a salicylic acid derivative is preferred in view of color development, a color hue with an absorption peak at from 570 to 620 nm, and the light-fastness of color images.

Specific examples of phenol derivatives include 4-tert-butylphenyl, 4-phenylphenol, 4-hydroxydiphenoxide, α-naphthol, β-naphthol, hexyl-4-hydroxybenzoate, 2,2'-dihydroxybiphenyl, 2,2-bis(4-hydroxyphenyl)-propane(bisphenol A), 4,4'-isopyridinebis(2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylydene diphenol, 4-tert-octylphenol, 4,4'-sec-butylydene diphenol, 4-p-methylphenylphenol, 4,4'-isopentylydene diphenol, 4,4'-methylcyclohexylydene diphenol, 4,4'-dihydroxydiphenylsulfide, 1,4-bis(4'-hydroxycumyl)benzene, 1,3-bis(4-hydroxycumyl)-benzene, 4,4'-thiobis(6-tert-butyl-3-methylphenol), 4,4'-dihydroxydiphenylsulfone, hydroquinone monobenzylether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethylorsellinate, cinnamylorsellinate, o-chlorophenoxyethylorsellinate, o-ethylphenoxyethylorsellinate, o-phenylphenoxyethylorsellinate, m-phenylphenoxyethylorsellinate, β-3'-t-butyl-4'-hydroxyphenoxyethyl 2,4-dihydroxybenzoate, 1-t-butyl-4-p-hydroxyphenylsulfonyloxbenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, ditollyl thiourea, or 4,4'-diacetyldiphenyl thiourea.

Specific examples of phenolic resins include psubstituted phenol formaldehyde resin, p-substituted phenol acetylene resin, carboxy-modified terpene-phenol resin containing gum turpentine and phenol, or carboxy-modified terpene-phenol resin containing dipentene and phenol.

As salicylic acid derivatives, mono- or di-substituted salicylic acid derivatives having at least 13 carbon atoms, with disubstituted salicylic acid derivatives being preferred, and the metal salts thereof are particularly preferred. The substituents for these salicylic acid derivatives include an alkyl group having from 1 to 12 carbon atoms, an aralkyl group having from 7 to 20 carbon atoms, a substituted or unsubstituted alkoxy group having from 1 to 20 carbon atoms, a halogen atom. Specific examples of salicylic acid derivatives include 3-phenylsalicylic acid, 3-cyclohexylsalicylic acid, 3,5-di-tert-butylsalicylic acid, 3,5-di-dodecylsalicylic acid, 3-methyl-5-benzylsalicylic acid, 3-phenyl-5-(α,α-dimethylbenzyl)salicylic acid, 3,5-di-(α-methylbenzyl)salicylic acid, 3,5-dicyclohexyl salicylic acid, 4-dodecyloxysalicylic acid, 4-octadecyloxysalicylic acid, 4-benzyloxysalicylic acid, 4-β-phenethyloxysalicylic acid, 4-β-phenoxyethoxy salicylic acid, 4-(4-phenoxybutoxy)salicylic acid, 5-(p'-α'-methylbenzyl-p-α-methylbenzyl)salicylic acid, 5-α-methyl-4'-phenylbenzyl salicylic acid, 4-β-p-tolyloxyethoxy salicylic acid, 4-β-p-methoxyethoxysalicylic acid, 4-β-p-butylphenoxyethoxy salicylic acid or the metal salts thereof (e.g., a zinc salt, an aluminum salt, a calcium salt). Among these, 3,5-di-(α-methylbenzyl)salicylic acid, 3,5-di-t-butyl salicyclic acid, 4-benzyloxy salicylic acid, 5-(p'-α'-methylbenzyl-p-α-methylbenzyl)salicylic acid, and the metal salts thereof are preferably used. Particularly preferred metal salt of salicylic acid derivatives is zinc salt in view of light fastness of colored image.

These organic acids may be used alone or in combination.

The recording material of the present invention containing the combination of a particular color former and developer produces a dye that is much more stable than the dye formed from conventional color formers and therefore, color change and color fading scarcely occur even after long term exposure to light, heat and moisture. Thus, the recording material of the present invention is particularly useful for long term storage of records. The combination of p-substituted amino-2-alkoxyphenylindolyl-4- or -7-azaphthalide and/or p-substituted amino-2-alkoxyphenylindolyl-4,7-diazaphthalide as a color former a disubstituted salicylic acid derivative having at least 13 carbon atoms, or a metal salt thereof is particularly preferable in view of light fastness of colored image.

In the recording material of the present invention, various well known compounds such as triphenylmethane phthalide type compounds (as described in U.S. Pat. Nos. 2,548,366 and 2,505,472), fluorane type compounds (as described in U.S. Pat. No. 3,681,390), phenothiazine type compounds (as described in Japanese Patent Application (OPI) No. 45319/73), indolylphthalide type compounds (as described in U.S. Pat. No. 3,829,322), leucoauramine type compounds (as described in Japanese Patent Publication No. 14873/61), rhodamine lactum type compounds (as described in U.S. Pat. No. 2,695,245), triphenylmethane type compounds (as described in Japanese Patent Publication No. 16052/71), triazine type compounds (as described in Japanese Patent Application (OPI) No. 41815/73) or spiropyrane type compounds (as described in Japanese Patent Publication No. 14039/70) can be used in combination with p-substituted aminophenylindolylazaphthalide. If such additives are used, it is preferred that the color former of the present invention be used in a ratio of at least about 60 wt %.

When the color former and the developer of the present invention are used for preparing a recording material, they are typically used in the form of fine dispersion or of fine droplets.

When they are used in a pressure-sensitive paper, various forms can be used, as disclosed in U.S. Pat. Nos. 2,505,470, 2,505,471, 2,505,489, 2,548,366, 2,712,507, 2,730,456, 2,730,457, 3,103,404, 3,418,250 and 4,010,038. Most typically, the pressure-sensitive paper is composed of at least two sheets separately containing a color former and a developer.

A color former sheet is generally prepared by mixing color formers alone or in combination, dissolving the mixture into a solvent such as a synthetic oil (e.g., alkylated naphthalene, alkylated diphenyl, alkylated diphenylmethane, alkylated terphenyl, chlorinated paraffin, etc.), a vegetable oil (e.g., cotton oil, castor oil, etc.), an animal oil, a mineral oil, or a mixture thereof, microencapsulating it and coating it on a support such as a paper, high quality paper, a plastic sheet or a resin coated paper. As a support, a neutral paper is the most preferred.

The color former of the present invention is highly soluble in synthetic oils such as alkylated naphthalene, alkylated diphenyl, alkylated diphenyl alkane, etc., providing the advantage that paraffin oils having a solubility for the color formers can be used in combination with the synthetic oils.

Additives such as ultraviolet absorbihg agents, antioxidants or the like may be incorporated into a microcapsule in addition to the color former. It is particularly preferred that a benzotriazole type ultraviolet absorbing agent, a hindered amine type antioxidant, a hindered phenol type antioxidant, an aniline type antioxidant, or a quinoline type antioxidant be added to improve the stability of a color former in a capsule and to prevent discoloration of the capsule.

As a method for preparing microcapsules, a gelatin coacervate method is best known. However, this method is not preferred in the present invention, because when a capsule containing a color former prepared by this method is used, fog occurs by contact with water (i.e., fog occurring by water immersion) or print-through color fog occurs during storage under high pressure and humidity (i.e., increasing fog occurring during storage under pressure and humidity).

Accordingly, the main wall material of a microcapsule of the present invention is preferably a synthetic resin such as polyurethane, polyurea, polyurethane urea or melamine-formaldehyde resin prepared by an interfacial polymerization method, an internal polymerization method or an external polymerization method.

A developer sheet is prepared by dispersing a developer alone or in mixture with another developer in a binder such as styrene butadiene latex or polyvinyl alcohol and coating the dispersion with a pigment on a support such as a paper, a plastic sheet or a resin coated paper, a neutral paper.

The amounts of the color former and developer are appropriately selected depending upon the desired coated thickness, the kind of a pressure sensitive material, the method of preparing capsules or other conditions. The amounts thereof can easily be determined by those skilled in the art.

When used for a heat-sensitive paper, both the color former and developer are pulverized to a particle size of about 10 μm or less, preferably about 3 μm or less in a dispersion medium. An aqueous solution of high molecular weight substance having from about 0.5 to 10% concentration is generally used as a dispersion medium. Dispersion is performed using a ball mill, a sand mill, a horizontal sand mill, an attritor, a colloid mill, etc.

The weight ratio of color former to developer is preferably from about 1:10 to 1:1, more preferably from about 1:5 to 2:3. It is preferred that a heat-fusible substance having a melting point of about 75° C. to 130° C., such as nitrogen-containing organic compounds (e.g., a fatty acid amide, acetoacetic anilide, diphenylamine, benzamide or carbazole), 2,3-di-m-tolylbutane, o-fluorobenzoyldurene, chlorobenzoylmesitylene, 4,4'-dimethylbiphenyl, carboxylic acid esters (e.g., dimethylisophthalate, diphenylphthalate, dimethylterephthalate or methacryloxybiphenyl) or polyether compounds, (e.g., di-m-trioxyethane, β-phenoxyethoxy anisole, 1-phenoxy-2-p-ethylphenoxyethane, bis-β-(p-methoxyphenoxy)ethoxymethane, 1-2'-methylphenoxy-2-4''-ethylphenoxyethane, 1-tolyloxy-2-p-methylphenoxyethane, 1,2-diphenoxyethane, 1,4-diphenoxybutane, bis-β-(p-ethoxyphenoxy)ethylether, 1-phenoxy-2-p-chlorophenoxyethane, 1,2'-methylphenoxy-2-4''-ethyloxyphenoxyethane, or 1-4'-methylphenoxy-2-4''-fluorophenoxyethane) be used in combination with the developer or color former in order to improve sensitivity. They are finely dispersed together with the color former or developer. It is particularly preferred to prevent fog that they be dispersed at the same time with the color former. The additive amounts thereof are in a weight ratio of from about 20% to 300%, preferably from about 40% to 150% based on the developer.

Various additives can further be added to the coating solution for various purposes.

For example, oil absorbing substances such as inorganic pigments or polyurea fillers are conventionally dispersed in a binder in order to prevent a recording head from being stained, and fatty acids, metal soaps and the like are added to reduce adhesion to improve parting property toward a head. Generally, conventional additives such as a pigment, a wax, an antistatic agent, an ultraviolet absorbent, a defoaming agent, an electroconductive agent, a fluorescent dye or a surfactant may be coated on a support without particular limitation, in addition to the coupler and developer which serve to form a color, to prepare recording material according to the invention.

More specifically, pigments are typically selected from those having a particle diameter of from about 0.1 to 15 μm such as kaolin, calcined kaolin, talc, agalmatolite, diatomaceous earth, calcium carbonate, aluminum hydroxide, magnesium hydroxide, calcined gypsum, silica, magnesium carbonate, titanium oxide, alumina, barium carbonate, barium sulfate, mica, microbaloon ureaformalin filler, polyethylene particles, cellulose filler, etc. Specific examples of waxes include paraffin wax, carboxy-modified paraffin wax, carnauba wax, microcrystalline wax, or polyethylene wax as well as higher fatty acid esters.

Specific examples of metal soaps include polyhydric metal salts of higher fatty acids, such as zinc stearate, aluminum stearate, calcium stearate, zinc oleate or the like.

These additives are dispersed in a binder and coated. Typical binders include water soluble binders such as polyvinyl alcohol, hydroxyethyl cellulose, hydroxypropyl cellulose, epichlorohydrin-modified polyamide, a copolymer of ethylene-maleic anhydride, a copolymer of styrene-maleic anhydride, a copolymer of isobutylene-maleic anhydride, polyacrylic acid, polyacrylic acid amide, methylol-modified polyacrylamide, starch derivatives, casein, gelatin or the like. Furthermore, a waterproofing agent (a gelling agent, a crosslinking agent) can be added to waterproof the binder, and an emulsion of a hydrophobic polymer such as a styrene-butadiene rubber latex, an acrylic resin emulsion, etc., can be also added. The coatingssolution is coated on a base paper, a high quality paper, a synthetic paper, a plastic sheet, a polyethylene-laminated high quality paper or a neutral paper in an amount of from about 2 to 10 g/m$^2$ preferably from 3 to 7 g/m$^2$.

Water-resistance can be further improved by providing on the surface of the coated layer a protective layer from about 0.2 to 2 μm thick, composed of a crosslinking agent and a water-soluble or a water dispersible high molecular weight compound such as polyvinyl alcohol, hydroxyethyl starch or epoxy-modified polyacrylamide.

The present invention can be used for various heat-sensitive paper types, such as those disclosed in German Patent Application (OLS) No. 2,228,581, 2,110,854 and Japanese Patent Publication No. 20142/77. Prior to recording, pre-heating, moisture adjustment or stretching of a coated paper can be performed as desired.

The above-described microcapsules can be applied to the heat-sensitive paper.

The invention can also be applied to electrothermic heat-sensitive papers having the forms such as those of the heat-sensitive paper as set forth above. The electrothermic heat-sensitive paper of the present invention is generally prepared by a method as disclosed in Japanese Patent Application (OPI) Nos. 11344/74 and 48930/75, for example, by coating on a support a coating solution having dispersed therein an electroconductive substance, a color former of the present invention and a developer in combination with a binder, or coating on a support an electroconductive substance to form an electroconductive layer and coating thereon a coating solution having dispersed therein a color former, a developer and a binder. In this instance, the above-described heat-fusible substances can be used in combination to improve sensitivities.

A light-sensitive pressure-sensitive paper according to the invention has the forms such as those of the pressure-sensitive paper. A method of preparing the light-sensitive pressure-sensitive paper is disclosed, for example, in Japanese Patent Application (OPI) No. 179836/82. Generally, photopolymerization initiating agents such as silver iodobromide, silver bromide, silver behenate, Michler's ketone, benzoin derivatives, or benzophenone derivatives, crosslinking agents of polyfunctional monomers such as polyallyl compounds, poly(meth)acrylate or poly(meth)acrylamide, together with a color former and, if necessary, a solvent are incorporated into a capsule having a wall of synthetic resin such as polyether urethane or polyurea. After imagewise exposure, the coupler in an unexposed area is contacted with the developer to form a color image.

The color former of the present invention is synthesized by a conventional method as described in British Pat. No. 2,031,934. The coupler is prepared, for example, by reacting benzoyl benzoic acid with indole, or the corresponding carboxybenzoylindole with aniline derivatives in the presence of a condensing agent such as acetic anhydride or phosphorus oxychloride, at a reaction temperature of from about 50° to 130° C. for from about 1 to 10 hours. The reaction product is then poured into ice water or into cooled dilute hydrochloric acid to hydrolyze the condensing agent. A volatile organic inactive solvent is added and, if necessary, such as chloroform, toluene or benzene chloride, an aqueous solution of sodium hydroxide is added to make the reaction product alkaline, the thus formed dye is transferred into the organic solvent and the solvent is removed under reduced pressure.

In view of light fastness of colored image, particularly preferred weight ratio of color former to developer is from about 1:5 to 2:3 in the heat-sensitive paper and is from about 1:10 to 2:3 in the pressure-sensitive paper.

The present invention is now illustrated in greater detail by the following Examples and Comparative Examples, but is not to be continued as being limited thereto. In Examples and Comparative Examples, all parts, percents and ratios are by weight.

EXAMPLES 1 TO 4

(1) Preparation of a color former sheet 1 g of the color former shown in Table 1 was dissolved in 30 g of diisopropyl naphthalene. Thus prepared solution was added with vigorous stirring into 50 g of water having dissolved therein 6 g of gelatin and 4 g of gum arabic to obtain an emulsion having oil droplets of from 1 to 10 μm diameter and thereafter 250 g of water was added thereto. Acetic acid was gradually added little by little into the emulsion to adjust the pH to about 4 and to cause coacervation, thereby forming a wall made of gelatin and gum arabic around oil droplets and then formalin was added to adjust the pH to 9, thereby hardening the wall so as to obtain the microcapsule having a particle diameter of 5.5 μm.

The thus obtained microcapsule dispersion was coated on a paper in a coating amount of 4 g/m$^2$ and dried to obtain a color former sheet.

(2) Preparation of a developer sheet 20 g of the developer shown in Table 1 was dispersed in 200 g of a 5% aqueous solution of polyvinyl alcohol (molecular weight: 20,000) and further 20 g of kaolin (Georgia kaolin produced by Georgia Pacific Co. (particle size: 1 μm)) was added thereto and sufficiently dispersed to obtain a coating solution. The coating solution was coated on a paper in a coating amount of 3 g/m$^2$ by solids and dried to obtain a developer sheet.

The thus obtained color former sheet and the developer sheet were superposed with the coated layers in contact, and upon pressure of 600 kg/cm$^2$ blue printed images were immediately obtained. The results of light fastness tests on these images are shown in Table 1.

COMPARATIVE EXAMPLES 1 AND 2

The same procedure as in Examples 1 to 4 was repeated to prepare a color former sheet and a developer sheet using the color former and the developer shown in Table 1. Color images were formed in the sme manner as in Example 1 and the same light fastness tests were carried out. The results are shown in Table 1.

Light fastness test

Light of 32,000 luxes was applied to the color images formed for 10 hours; the color densities before and after exposure were compared; and the residual percentage was calculated. The color densities were measured by a Macbeth RD-918 densitometer.

$$\text{Residual percentage of color formed} = \frac{\text{Color density after exposure}}{\text{Color density before exposure}} \times 100\ (\%)$$

TABLE 1

| Example No. | Color former | Developer | Light fastness |
|---|---|---|---|
| 1 | 3-(4-diethylamino-2-ethoxy-phenyl)-3-(1-ethyl-2-methyl-indol-3-yl)-4-azaphthalide | zinc 3,5-bis(α-methylbenzyl)-salicylate | A |
| 2 | 3-(4-diethylamino-2-ethoxy-phenyl)-3-(1-n-octyl-2-methyl-indol-3-yl)-4-azaphthalide | " | A |
| 3 | 3-(4-diethylamino-2-ethoxy-phenyl)-3-(1-n-octyl-2-methyl-indol-3-yl)-4,7-diazaphthalide | " | A |
| 4 | 3-(4-diethylamino-2-ethoxy-phenyl)-3-(1-n-octadecyl-2-methyl-indol-3-yl)-4-azaphthalide | zinc 5-α-(α-methyl-benzyl)-phenethyl-salicylate | A |
| Comparative Example 1 | crystal violet lactone | zinc 3,5-bis(α-methylbenzyl)-salicylate | C |
| Comparative Example 2 | 3-(4-diethylamino-2-ethoxy-phenyl)-3-(1-ethyl-2-methyl-indol-3-yl)-4-azaphthalide | silton clay | C |

(Note) Results of light fastness test:
A: Residual percentage of color formed is 75% or more.
B: Residual percentage of color formed is from 50 to 75%.
C: Residual percentage of color formed is from 25 to 50%.
D: Residual percentage of color formed is 25% or less.

EXAMPLE 5

30 parts of 3-(4-diethylamino-2-n-octadecyloxy-phenyl)-3-(1-ethyl-2-methylindol-3-yl)-4-azaphthalide was mixed with 150 parts of a 10% aqueous solution of polyvinyl alcohol(molecular weight: 40,000) and 70 parts of water and pulverized in a ball mill for 12 hours. The resulting dispersion had a particle diameter of about 1.5 μm. (Component A)

30 parts of zinc 4-β-(p-methoxyphenoxy)ethoxy salicylate, 30 parts of 2-benzyloxynaphthalene, 150 parts of a 10% aqueous solution of polyvinyl alcohol (molecular weight: 40,000) and 55 parts of water were mixed and pulverized in a sand mill to prepare a dispersion. The insoluble substance had a particle diameter of about 2 μm. (Component B)

5 parts of component A and 40 parts of component B were mixed, coated on a paper and dried to obtain a heat-sensitive paper having a coating amount of 6 g/m$^2$ by solids.

Blue color was formed on the heat-sensitive paper where heat was applied by a thermal pen. The hue and color densities of the thus-obtained color images were measured before and after the images were exposed to an ultraviolet lamp for 1 hour. The hue was visually observed and the color density was measured by a Macbeth densitometer. As a result, hue and color densities scarcely changed.

EXAMPLES 6 TO 13

(1) Preparation of a developer sheet 10 parts of the developer shown in Table 2 was added to 20 parts of 1-isopropylphenyl-2-phenylethane and heated at 90° C. and dissolved. The resulting solution was added to 50 parts of a 2% aqueous solution of polyvinyl alcohol ("PVA-117" manufactured by Kuraray Co., Ltd. (molecular weight: 75,000)), and 0.1 part of 10% aqueous solution of triethanol amine of dodecylbenzene sulfonate was further added thereto as a surfactant. An emulsion having a particle diameter of 3 μm was prepared by a homogenizer.

80 parts of calcium carbonate, 20 parts of zinc oxide, 1 part of sodium hexamethaphosphate and 200 parts of water was dispersed by a kedy mill for 10 minutes to prepare a dispersion and then the above-described emulsion was added thereto. Thereafter, 100 parts of 10% aqueous solution of PVA-117 (manufactured by Kuraray Co., Ltd.) and 10 parts by solids content of caboxy-modified SBR latex ("SN-307," manufactured by Sumitomo Naugatuc Co., Ltd. (particle size: 0.3 μm)) as a binder were added, and water was added to the mixture to adjust solids content to a concentration of 20%, to prepare coating solution (A).

10 parts of the developer, 20 parts of silton clay, 60 parts of calcium carbonate, 20 parts of zinc oxide, 1 part of sodium hexamethaphosphate and 200 parts of water were mixed and uniformly dispersed by a sand grinder to prepare a dispersion having an average particle diameter of 3 μm.

To the thus-obtained dispersion, 16 parts of a 10% aqueous solution of PVA-103 (manufactured by Kuraray Co., Ltd.) and 100 parts of a 10% aqueous solution of PVA 117 (prepared by Kuraray) and 10 parts by solids content of carboxy-modified SBR latex ("SN-307," manufactured by Sumitomo Naugatuc Co., Ltd.) were added, and thereafter water was added to adjust the solids concentration of the dispersion to 20%, and prepare coating solution (B).

The coating solutions (A) and (B) were mixed in a mixing ratio of A/B=50/50 in terms of the amount of the developer and coated on a base paper (50 g/m$^2$) by an air knife coater to a solids content of 5.0 g/m$^2$, and then dried to obtain a developer sheet.

(2) Preparation of a color former containing capsule sheet

I. Melamine-formaldehyde resin capsule 5 parts of sodium polyvinylbenzene sulfonate ("VERSA, TL 500," manufactured by National Starch Co., Ltd. (average molecular weight: 500,000)) was dissolved in 95 parts of hot water having a temperature of about 80° C. with stirring. After it was dissolved for about 30 minutes, it was cooled. The aqueous solution had a pH of from 2 to 3, and a 20 wt % aqueous solution of sodium hydroxide was added thereto to adjust the pH to 4.0. 100 parts of diisopropyl naphthalene having dissolved therein the color former shown in Table 2 in an amount of 3.5% was added to 100 parts of a 5% aqueous solution of sodium polyvinylbenzene sulfonate prepared above, emulsified and dispersed to obtain an emulsion having an average particle size (diameter) of 4.5 μm. 6 parts of melamine, 11 parts of a 37 wt % aqueous solution of formaldehyde and 30 parts of water were mixed and heated at 60° C. with stirring and after 30 minutes, a mixed aqueous solution of transparent melamine, formaldehyde and an initially condensed product of melamine and formaldehyde were obtained. The mixed aqueous solution had appH of from 6 to 8. Hereinafter, the mixed aqueous solution of melamine, formaldehyde and the initially condensed product of melamine-formaldehyde is referred to as the "initially condensed solution." 47 parts of the initially condensed solution thus obtained was added to the above-described emulsion, mixed and while stirring, the pH thereof was adjusted to 6.0 by the addition of a 3.6 wt % phosphoric acid solution and the solution was heated to 65° C. with stirring for 360 minutes. The thus-obtained microcapsule solution was cooled to room temperature, and the pH thereof was adjusted to 9.0 by the addition of a 20 wt % aqueous solution of sodium hydroxide.

200 parts of a 10 wt % aqueous solution of polyvinyl alcohol (molecular weight: 20,000) and 50 parts of starch particles (size: 15 μm) were added to the microcapsule solution, and water was added thereto to adjust the solids content concentration to 20% to obtain a coating solution containing a microcapsule dispersion.

The coating solution was coated on a base paper (50 g/m$^2$) in a coating amount of 5 g/m$^2$ by solids content by an air knife coater, and dried to obtain a color former-containing capsule sheet according to the present invention.

II. Polyurethane urea capsule

Into 30 g of diisopropyl naphthalene, an oily solution having dissolved therein the color former as shown in Table 2 in an amount of 3.5%, and as wall forming substances 8 g of a polyhydric isocyanate compound (an adduct product of 3 mol tolylene diisocyanate and 1 mol trimethylol propane) and 1 g of a polyhydric hydroxy compound (an adduct product of ethylenediamine and propyleneoxide) were added and mixed at 20° C. or lower to prepare a primary solution.

Subsequently, 3 g of polyvinyl alcohol and 1.5 g (molecular weight: 20,000) of sodium carboxymethyl cellulose (molecular weight: 30,000; degree of substitution: 120) were dissolved in 44 g of water at 20° C., and 0.1 g of Turkey red oil (emulsifying agent) was added thereto to prepare a secondary solution. The above-described primary solution was poured into the secondary solution with vigorous stirring to prepare an oil in water type emulsion. When the oil droplet size reached 4.5 μm, stirring was slowed, 100 g of water at 20° C. was added to the emulsion. The temperature of the system was gradually raised to 75° C. and was kept at 75° C. for 60 minutes.

Into the thus-obtained capsule solution, 25 g of a 15% aqueous solution of polyvinyl alcohol (molecular weight: 20,000), 42 g (by solid content) of carboxy-modified SBR latex (particle size: 0.3 μm) and 20 g of starch particles (average particle diameter: 15 μm) were added.

Then, water was added to the capsule solution to adjust the solids content to 20%, and thus a coating solution was prepared.

The coating solution was coated by an air knife coater on a base paper (50 g/m$^2$) to a dry weight coating amount of 5 g/m$^2$, to obtain a microcapsule sheet.

III. Gelatin capsule 20 parts of acid treated gelatin having an isoelectric point of 8.0 and 20 parts of gum arabic were dissolved into 120 parts of water at 40° C. Next 0.4 parts of sodium alkylbenzene sulfonate as an emulsifying agent was added thereto, and thereafter 200 parts of diisopropyl naphthalene having dissolved therein the color former shown in Table 2 in an amount of 3.5% was also added thereto with vigorous stirring to emulsify the solution. When the particle size of the emulsion reached 4.5 μm, 200 parts of water at 40° C. was added thereto to prevent emulsification from proceeding.

With additional stirring, 420 parts of water at 30° C. was added, and then 20% acetic acid was also added to the emulsion to adjust the pH of the system to 4.4. The solution of the emulsion was cooled to 8° C. with stirring, and 1.0 part of 37% formaldehyde and 1.5 parts of 20% glutaraldehyde were added thereto.

Then, 60 parts of a 10% aqueous solution of carboxymethyl cellulose (molecular weight: 30,000; degree of substitution: 120) was added, and a 25% aqueous solution of sodium hydroxide was dropwise added to the emulsion so that the solution had pH of 9.5, and the solution was heated to 30° C. to obtain microcapsules having hard walls. 200 parts of a 10% aqueous solution of polyvinyl alcohol (molecular weight: 20,000) and 50 parts of starch particles (diameter: 15 μm) were added to the capsule dispersion, and water was added to adjust the solids content thereof to 20% to obtain a coating solution containing a microcapsule dispersion.

The coating solution was coated by an air knife coater on a base paper (50 g/m$^2$) to a solids coverage of 5 g/m$^2$ and dried to obtain a color former containing capsule sheet.

The thus-obtained developer sheet and color former containing capsule sheet were combined in the manner shown in Table 2 to form a pressure-sensitive recording sheet and each combination was tested and compared.

With a developer sheet and a color former containing capsule sheet being contacted at the coated layers, a comparison was made regarding fog (i.e., fog formed by water immersion and fog occurring under pressure and humidity) and the results are shown in Table 1.

(A) Fog on water immersion

The developer sheet and the color former-containing capsule sheet were contacted at the coated layers and immersed in water for 1 minute. After drying for 24 hours, the fog density in the color former-containing capsule sheet was measured using a Beckman DB spectrophotometer.

(B) Fog under pressure and humidity

A pressure of 100 g cm$^2$ was applied to the superposed developer sheet and color former containing capsule sheet, which were allowed to stand at 50° C. under high humidity conditions of 90% RH for 24 hours. Thereafter, fog on the developer sheet was visually evaluated.

It is understood from Table 2, that the recording material of the present invention prepared using a synthetic resin capsule wall main component exhibited remarkably excellent results.

TABLE 2

| Example No. | Developer sheet Developer | Color-former-containing capsule sheet Capsule | Color former (concentration) | Color density formed by soaking in water | Fog in accumulating state under humid conditions |
|---|---|---|---|---|---|
| 6 | zinc 3,5-bis(α-methylbenzyl)-salicylate | melamine-formaldehyde resin | 3-(4-diethylamino-2-ethoxyphenyl)-3-(1-n-octadecyl-2-methylindol-3-yl)-4-azaphthalide (3.5%) | 0.15 | A |
| 7 | " | polyurethane urea capsule | " | 0.16 | A |
| 8 | " | gelatin capsule | " | 0.45 | C |
| 9 | " | melamine-formaldehyde resin capsule | 3-(4-diethylamino-2-ethoxyphenyl)-3-(1-n-octyl-2-methylindol-3-yl)-4-azaphthalide (2.5%) crystal violet lactone (1.0%) | 0.14 | A |
| 10 | " | " | 3-(4-diethylamino-2-ethoxyphenyl)-3-(1-ethyl-2-methylindol-3-yl)-4-azaphthalide (2.5%) 3,6-bis(diphenylamino)fluorane (1.0%) | 0.18 | A |
| 11 | zinc 5-α-(methylbenzyl)-phenethyl salicylate | " | 3-(4-diethylamino-2-ethoxyphenyl)-3-(1-n-octyl-2-phenylindol-3-yl)-4-azaphthalide (3.5%) | 0.16 | A |
| 12 | " | polyurethane urea capsule | " | 0.18 | A |
| 13 | " | gelatin capsule | " | 0.39 | C |

(Note)
A: excellent, B: practically acceptable, C: unpractical

While the invention has been described in detail and with reference to specific embodiments thereof, it will be apparent to one skilled in the art that various changes and modifications can be made therein without departing from the spirit and scope thereof.

What is claimed is:

1. A recording material comprising a support or supports ahving provided thereon a layer containing at least one electron-donating colorless dye comprising a p-substituted aminophenylindolyazaphthalide and a layer containing at leaat one electron-accepting compound selected from the group consisting of zinc 3,5-bis (α-methylbenzyl) salicylate and zinc 5-α-(α-methylbenzyl)-phenethylsalicylate.

2. A recording material as claimed in claim 1, wherein said colorless dye is a p-substituted aminophenylindolylazaphthalide represented by the following formula (I)

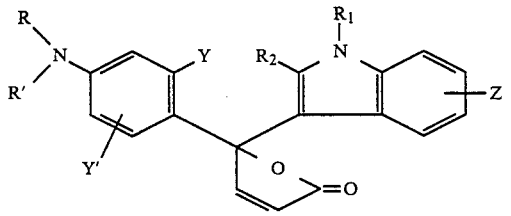

(I)

A wherein R and R', which may be the same or different, each represents a substituted or unsubstituted alkyl group; $R_1$ and $R_2$, which may be the same or different, each represents a hydrogen atom a substituted or unsubstituted alkyl group or a substituted or unsubstituted aryl group; Y, Y' and Z, which may be the same or different, each represents a hydrogen atom, a substituted or unsubstituted alkyl group, a halogen atom, a substituted amino group or a substituted or unsubstituted alkoxy group; and A represents an atomic group necessary for completing a pyridine ring or a pyrazine ring.

3. The recording material as claimed in claim 2, wherein said aryl group represented by $R_1$ and $R_2$ is selected from the group consisting of a phenyl group, a naphthyl group and a heterocyclic group, and said substituted aryl group is substituted with a group selected from the group consisting of an alkyl group, an alkoxy group, an aryloxy group, a halogen atom, a nitro group, a cyano group, a substituted carbamoyl group, a substituted sulfamoyl group, a substituted amino group, a substituted oxycarbonyl group, and a substituted oxysulfonyl group; said alkyl group represented by R, R', $R_1$, $R_2$, Y, Y' and Z is substituted with a substituent selected from the group consisting of an aryl group, an alkoxy group, an aryloxy group, a halogen atom and a cyano group; and said pyridine ring is selected from the group consisting of a pyridine ring having a nitrogen atom at the 4-position of the azaphthalide ring and a pyridine ring having a nitrogen atom at the 7-position of the azaphthalide ring.

4. The recording material as claimed in claim 3, wherein R and R', which may be the same or different, each represents an alkyl group having from 1 to 10 carbon atoms, an alkoxyalkyl group having from 1 to 10 carbon atoms, an alkyl group having from 1 to 10 carbon atoms substituted with a halogen atom, and an aryloxyalkyl group having from 7 to 12 carbon atoms; $R_1$ represents an alkyl group having from 1 to 18 carbon atoms, an alkyl group having from 1 to 18 carbon atoms which is substituted with a substituent selected from the group consisting of an aryl group, an alkoxy group, an aryloxy group, or a halogen atom, a phenyl group having from 6 to 10 carbon atoms, a phenyl group having from 6 to 10 carbon atoms which is substituted with a substituent selected from the group consisting of an alkyl group, an alkoxy group, or a halogen atom; $R_2$ represents a hydrogen atom, an alkyl group having from 1 to 8 carbon atoms or a phenyl group having from 6 to 10 carbon atoms; Y and Y', which may the same or different, each represents a hydrogen atom, an alkyl group having from 1 to 18 carbon atoms, a substituted amino group having from 1 to 18 carbon atoms, or an alkoxy group having from 1 to 18 carbon atoms; Z represents a hydrogen atom, an alkyl group having from 1 to 6 carbon atoms, or an alkoxy group having from 1 to 6 carbon atoms; and the pyridine ring has a nitrogen atom at the 4-position of the azaphthalide ring.

5. The recording material as claimed in claim 4, wherein R and R' each represents an ethyl group, an n-butyl group, a phenyl group or a benzyl group; $R_1$ represents an ethyl group, an n-butyl group, an n-octyl group, a 2-ethylhexyl group, an n-dodecyl group, an n-octadecyl group, a benzyl group, and a phenoxyethyl group; $R_2$ represents a hydrogen atom, a methyl group and a phenyl group; Y and Y' each represents an ethoxy group, a methoxy group, an n-butoxy group, a benzyloxy group, a methyl group, and a halogen atom; Z represents a hydrogen atom, a chlorine atom, a methyl group and a methoxy group; and the groups represented by R, R', Y, $R_1$ and $R_2$ have a total of at least 8 carbon atoms.

6. The recording material as claimed in claim 5, wherein $R_2$ represents an alkyl group or Y represents an alkoxy group, and the group represented by $R_1$ or Y has 4 or more carbon atoms.

7. The recording material as claimed in claim 6, wherein the group represented by $R_1$ or Y has from 6 to 18 carbon atoms.

8. The recording material as claimed in claim 2, wherein said colorless dye comprises a p-substituted amino-2-alkoxyphenylindolyl-4- or -7-azaphthalide or a p-substituted amino-2-alkoxyphenylindoly-4,7-diazaphthalide.

9. The recording material as claimed in claim 1, wherein said colorless dye is contained in microcapsules having walls mainly comprising a synthetic resin.

10. A recording material as claimed in claim 9, wherein said recording material is a pressure-sensitive recording material.

11. The recording material as claimed in claim 9, wherein said synthetic resin is selected from the group consisting of a polyurethane, a polyurea, a polyurethane urea and a melamine-formaldehyde resin.

12. The recording material as claimed in claim 1, wherein said recording material is a heat-sensitive paper.

13. The recording material as claimed in claim 12, wherein the weight ratio of said colorless dye to said electron-accepting compound is from about 1:10 to 1:1.

14. The recording material as claimed in claim 12, wherein the weight ratio of said colorless dye to said electron-accepting compound is from about 1:5 to 2:3.

15. The recording material as claimed in claim 12, wherein said heat-sensitive paper contains a compound having a melting point of about 75° C. to 130° C. selected from the group consisting of a nitrogen-containing organic compound, 2,3-di-m-tolyl-butane, o-fluorobenzoyldurene, chlorobenzoylmesitylene, 4,4'-dimethylbiphenyl, a carboxylic acid ester, and a polyether compound, in an amount of from about 20 to 300 wt % based on said electron-accepting compound.

16. The recording material as claimed in claim 1, wherein said recording material is an electrothermic heat-sensitive paper.

17. The recording material as claimed in claim 1, wherein said recording material is a light-sensitive pressure-sensitive paper.

18. The recording material as claimed in claim 1, wherein said colorless dye is a p-substituted amino-2-alkoxyophenylondolyl-4- or -7-azaphthalide and/or a p-substituted amino-2-alkoxyphenylindolyl-4,7-diazaphthalide.

* * * * *

UNITED STATES PATENT AND TRADEMARK OFFICE

CERTIFICATE OF CORRECTION

PATENT NO. : 4,861,748

DATED : August 29, 1989

INVENTOR(S) : Keiso Saeki, Masanobu Takashima and Ken Iwakura

It is certified that error appears in the above-identified patent and that said Letters Patent is hereby corrected as shown below:

On the title page:

In item [*] (Notice), please delete "Dec. 21, 2088".

Signed and Sealed this

Twentieth Day of November, 1990

*Attest:*

*Attesting Officer*

HARRY F. MANBECK, JR.

*Commissioner of Patents and Trademarks*